US011603725B2

(12) United States Patent
Wang et al.

(10) Patent No.: US 11,603,725 B2
(45) Date of Patent: Mar. 14, 2023

(54) ORIENTING GEOLOGIC CORE SAMPLES

(71) Applicant: Saudi Arabian Oil Company, Dhahran (SA)

(72) Inventors: Weihua Wang, Dhahran (SA); Yunsheng Li, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/217,710

(22) Filed: Mar. 30, 2021

(65) Prior Publication Data

US 2022/0316293 A1 Oct. 6, 2022

(51) Int. Cl.
*E21B 25/16* (2006.01)
*E21B 47/024* (2006.01)

(52) U.S. Cl.
CPC ..... *E21B 25/16* (2013.01); *E21B 47/024* (2013.01)

(58) Field of Classification Search
CPC ..... E21B 25/16; E21B 47/024
See application file for complete search history.

(56) References Cited

U.S. PATENT DOCUMENTS 2,260,562 A * 10/1941 Dillon ..... E21B 47/026 324/377
2,489,566 A * 11/1949 Engle ..... E21B 25/16 33/1 E
2,709,069 A * 5/1955 Boucher ..... E21B 25/16 324/377
4,211,974 A 7/1980 Henry
4,311,201 A * 1/1982 Stewart ..... E21B 25/16 33/308
6,659,196 B1 * 12/2003 Anderson ..... E21B 25/16 33/304
9,483,871 B2 11/2016 Sung et al.
10,047,581 B2 * 8/2018 Drenth ..... E21B 25/16
10,689,978 B2 * 6/2020 Al-Sofi ..... G01N 33/24
2016/0032672 A1 2/2016 Parfitt
2016/0109603 A1 * 4/2016 Jin ..... G01N 29/225 73/152.58
2017/0131192 A1 * 5/2017 Perez ..... G01N 3/08
2019/0040735 A1 * 2/2019 McLeod ..... E21B 47/024

FOREIGN PATENT DOCUMENTS

WO WO 2020219035 10/2020
WO WO 2020222757 11/2020

OTHER PUBLICATIONS

Fractured core analysis: interpretation, logging, and use of natural and induced fracture in core, Kulander, American Association of Petroleum Geologist Methods in Exploration Series 8, 1990, Chapter 3, pp. 35-39, 13 pages.

(Continued)

*Primary Examiner* — Jonathan Malikasim
(74) *Attorney, Agent, or Firm* — Fish & Richardson P.C.

(57) ABSTRACT

A horizontal or deviated core sample is received from a wellbore. A presence of geologic indicators within the horizontal or deviated core sample is determined. The horizontal or deviated core sample is rotated to a position based on the presence and orientation of the geologic indicators. A top of the horizontal or deviated core sample is marked after the core has been rotated.

20 Claims, 6 Drawing Sheets

(56) References Cited

OTHER PUBLICATIONS

Hailwood, "Palaeomagnetic reorientation of cores and the magnetic fabric of hydrocarbon reservoir sands," In: Turner, P., Turner, A. (Eds.), Palaeomagnetic Applications in Hydrocarbon Exploration and Production, Geological Society Special Publication, 1995, 98:245-258, 14 pages.

Lofts et al., "Feature recognition and the interpretation of images acquired from horizontal wellbores," From Lovell, M.A. & Harvey, P.K. (eds.), Developments in Petrophysics, Geological Society Special Publication No. 122, 1997, pp. 345-365, 21 pages.

Mathis et al., "Orientation and calibration of core and borehole image data," Society of Professional Well Log Analysts 36th Annual Logging Symposium, Jun. 26-29, 1995, 12 pages.

Nelson, "Oriented core: its use, error, and uncertainty," The American Association of Petroleum Geologists Bulletin, 1987, 71:357-367, 11 pages.

Paulsen, "A simple method for orienting drill core by correlating features in whole-core scans and oriented borehole-wall imagery," Journal of Structural Geology , 2002, 24:1233-1238, 6 pages.

Payenberg, "A simple method for orienting conventional core using microresistivity (FMS) images and a mechanical goniometer to measure directional structures on cores," Journal of sedimentary Research, 2000, 70:419-422, 4 pages.

* cited by examiner

ORIENTING GEOLOGIC CORE SAMPLES

TECHNICAL FIELD

This disclosure relates receiving and processing core samples recovered from geologic formations.

BACKGROUND

When evaluating geologic formations, for example, for hydrocarbon production, core samples are often taken for study. In some instances, the core samples can come from their own, individual borehole. In some instances, the core samples can be recovered from a wall of a wellbore. Recovering core samples generally involves drilling the sample out with a coring drill bit to produce a cylindrical core sample. Core plug samples are then taken from the cylindrical core sample and are then subjected to tests to determine properties of the geologic formation, such as porosity or permeability.

SUMMARY

This disclosure describes technologies relating to orienting core samples.

An example of the subject matter described within this disclosure is a method of orienting a horizontal or deviated core sample. The method includes the following features. A horizontal or deviated core sample is received from a wellbore. A presence of geologic indicators within the horizontal or deviated core sample is determined. The horizontal or deviated core sample is rotated to a position based on the presence and orientation of the geologic indicators. A top of the horizontal or deviated core sample is marked after the core has been rotated.

Aspects of the example method, which can be combined with the example method alone or in combination with other aspects, include the following. The core sample is a horizontal core sample. The geologic indicators include graded bedding or trough cross bedding.

Aspects of the example method, which can be combined with the example method alone or in combination with other aspects, include the following. Rotating the core includes rotating the core such that finning up sequences of the geologic indicators are oriented such that a top line of the core is directed upwards.

Aspects of the example method, which can be combined with the example method alone or in combination with other aspects, include the following. Rotating the core includes rotating the core such that trough sequences of the geologic indicators are oriented such that a top line of the trough is directed upwards.

Aspects of the example method, which can be combined with the example method alone or in combination with other aspects, include the following. Marking includes marking the top of the core with a writing instrument.

Aspects of the example method, which can be combined with the example method alone or in combination with other aspects, include the following. A vertical plug is retrieved from the core sample. A horizontal plug is retrieved from the core sample.

Aspects of the example method, which can be combined with the example method alone or in combination with other aspects, include the following. The core sample is a deviated core sample. Retrieving the vertical plug includes determining a slope angle of the core sample, and orienting the core sample such that a vertical plug can be taken based on the determined slope angle.

Aspects of the example method, which can be combined with the example method alone or in combination with other aspects, include the following. The core sample is a first core sample. The method further includes receiving a second core sample from the wellbore. The second core sample is from a same borehole as the first core sample. A presence of geologic indicators in the second core sample is determined. The second core sample is rotated in response to the presence and location of the geologic indicators in the second core sample. The top of the second core sample is marked after the second core sample has been rotated. The mark of the first core sample and the second core sample are aligned.

An example implementation of the subject matter described herein is a method with the following features. A horizontal or deviated core sample is drilled from a geologic formation. A presence of geologic indicators within the core sample is determined. The core sample is rotated to a position based on the presence and orientation of the geologic indicators. A top of the core is marked after the core has been rotated.

Aspects of the example method, which can be combined with the example method alone or in combination with other aspects, include the following. The geologic indicators include graded bedding, or trough cross bedding.

Aspects of the example method, which can be combined with the example method alone or in combination with other aspects, include the following. Rotating the core includes rotating the core such that finning up sequences of the geologic indicators are oriented such that a top line of the core is directed upwards.

Aspects of the example method, which can be combined with the example method alone or in combination with other aspects, include the following. Rotating the core includes rotating the core such that trough sequences of the geologic indicators are oriented such that a top line of the trough is directed upwards.

Aspects of the example method, which can be combined with the example method alone or in combination with other aspects, include the following. Marking includes marking the top of the core with a writing instrument.

Aspects of the example method, which can be combined with the example method alone or in combination with other aspects, include the following. A vertical plug is retrieved from the core sample. A horizontal plug is retrieved from the core sample.

Aspects of the example method, which can be combined with the example method alone or in combination with other aspects, include the following. A vertical plug is retrieved from the core sample. Retrieving the vertical plug includes determining a slope angle of the core sample, and orienting the core sample such that a vertical plug can be taken based on the determined slope angle.

Aspects of the example method, which can be combined with the example method alone or in combination with other aspects, include the following. The core sample is a first core sample. The method further includes receiving a second core sample from the geologic formation. The second core sample is from a same borehole as the first core sample. A presence of geologic indicators in the second core sample is determined. the second core sample is rotated in response to the presence and location of the geologic indicators in the second core sample. A top of the second core sample is marked after the second core sample has been rotated. The mark of the first core sample and the second core sample are aligned with one another.

Aspects of the example method, which can be combined with the example method alone or in combination with other aspects, include the following. Receiving the second core sample includes drilling the second core sample from the same wellbore as the first core sample.

An example implementation of the subject matter described within this disclosure is a method with the following features. A horizontal or deviated core sample are drilled from a geologic formation. A presence of geologic indicators within the core sample is determined. The geologic indicators includes graded bedding or trough cross bedding. the core sample is rotated to a position such that finning up sequences of the geologic indicators are oriented such that a top line of the core sample is directed upwards, or that trough sequences of the geologic indicators are oriented such that a top line of the trough is directed upwards. A top of the core is marked after the core has been rotated.

Aspects of the example method, which can be combined with the example method alone or in combination with other aspects, include the following. The core sample is a first core sample. The method further includes drilling a second core sample from the geologic formation. The second core sample is from a same borehole as the first core sample. A presence of geologic indicators in the second core sample is determined. The geologic indicators include graded bedding or trough cross bedding. The second core sample is rotated to a position such that finning up sequences of the geologic indicators are oriented such that a top line of the core is directed upwards, or that trough sequences of the geologic indicators are oriented such that a top line of the trough is directed upwards. A top of the second core sample is marked after the second core sample has been rotated. The mark of the first core sample and the second core sample are aligned with one another.

Aspects of the example method, which can be combined with the example method alone or in combination with other aspects, include the following. A vertical plug is retrieved from the second core sample. A horizontal plug is retrieved from the second core sample.

Particular implementations of the subject matter described in this specification can be implemented so as to realize one or more of the following advantages. The subject matter described herein allow a field geologist of a lab technician to orient core samples without the need for extensive in-house core reorientation processes which compare scanned core images and scanned borehole images to orient the cores. The subject matter described herein allow a field geologist to orient the intact core before the core segmented into 3 ft pieces in the well site. Which can save lab technician huge amount of time to orient 3 ft by 3 ft core.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Geologic core samples are often used to evaluate properties of a geologic formation. Many of these properties are anisotropic, meaning that the properties can vary depending upon the direction the property is measured within the material. Because of this, care sample often have plugs taken from them in specific orientations. These plugs are then tested for the desired property. In order to apply the test findings to the geologic formation from which the cores were recovered, an orientation of the core samples and the plugs must be known relative to the geologic formation.

This disclosure describes a method of orienting a core sample. A horizontal of deviated core sample is received. A presence of geologic indicators is determined to be present, for example, by a field geologist or a laboratory technician. An orientation of the received core sample can be determined based on the presence of these geologic indicators, and the core sample can be oriented based on the geologic indicators. Orientation can, in some implementations, include rotating the core such that a top of the core, relative to the geologic formation, is accessible to the lab technician. The top of the core sample can then be marked with a standard writing instrument, such as a marker or a grease pencil. The mark allows future lab technicians to quickly orient the core sample as desired.

Figure 1:
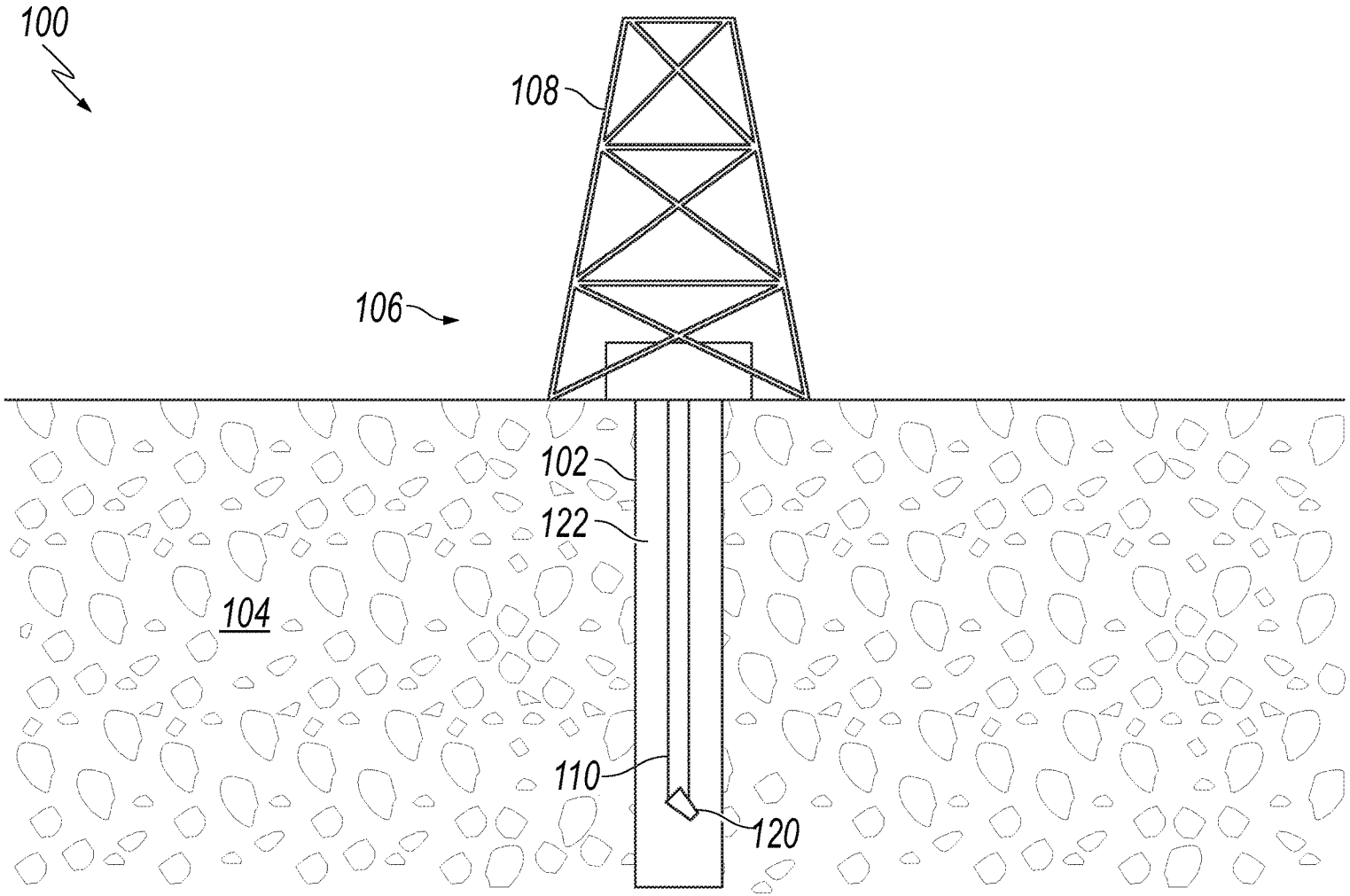
FIG. 1 is a side cross sectional view of an example wellsite.

FIG. 1 is a side cross sectional view of an example wellsite 100. The wellsite 100 includes a wellbore 102 formed within a geologic formation 104. At an uphole end of the wellbore 102 is a topside facility 106. In some implementations, the topside facility 106 can include a derrick 108. The derrick 108 can be used to support a workstring 110 within the wellbore 102. While primarily illustrated and described as using a derrick to support the workstring 110, other support systems, such as a coiled tubing truck, can be used without departing from this disclosure. While illustrated as a vertical wellbore for simplicity, the subject matter described herein is similarly applicable to horizontal or deviated wellbores.

At a downhole end of the workstring 110 is a bottomhole assembly (BHA) 120. For the purposes of this disclosure, the BHA 120 includes a coring tool, such as a coring drill bit, that is capable of drilling and retrieving core samples from a wall of the wellbore 102. Such a coring tool can retriever vertical cores, deviated cores, horizontal cores, or a combination based upon the configuration of the tool. Often, the orientation of the cores retrieved by the BHA 120 is lost during coring operations. For example, the core sample rotates during retrieval. As such, to determine directional properties of the core sample (and the geologic formation 104), a proper orientation of the core sample is determined after the core sample is received from the wellbore 102.

Figure 2A:
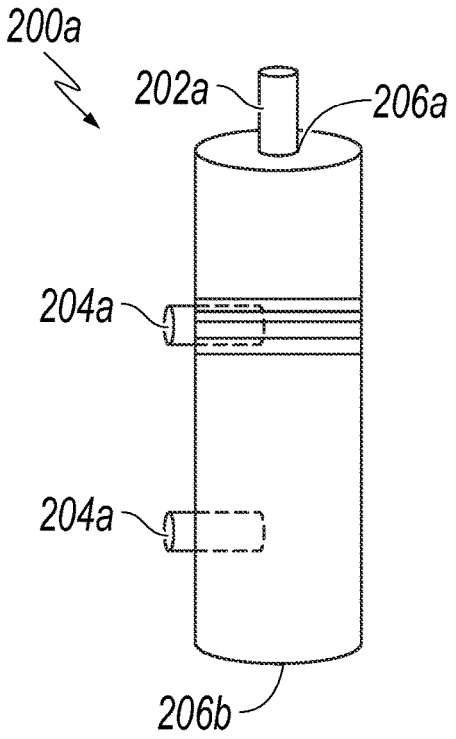
FIG. 2A is a side cross sectional view of an example vertical core sample marked to have vertical and horizontal plugs removed.

FIG. 2A is a side cross-sectional view of an example vertical core sample 200*a* marked to have vertical plugs 202*a* and horizontal plugs 204*a* removed. The vertical core sample 200*a* does not need to have positions determined after being received from the wellbore 102 to retrieve vertical and/or horizontal plugs. Indeed, the distal and proximal ends of cores are typically apparent based upon marks left during core extraction. As such, the uphole end 206*a* and the downhole end 206*b* are known, and horizontal and vertical plugs can be taken without doubt as to the orientation relative to the geologic formation.

Figure 2B:
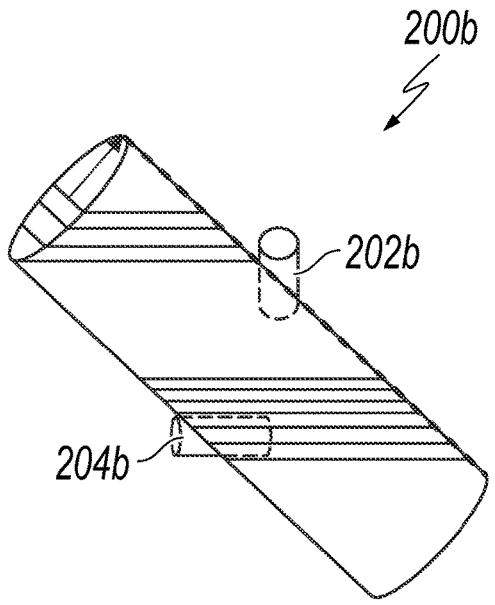
FIG. 2B is a side cross sectional view of an example deviated core sample marked to have vertical and horizontal plugs removed.

FIG. 2B is a side cross-sectional view of an example deviated core sample 200*b* marked to have vertical plugs 202*b* and horizontal plugs 204*b* removed. As can be seen by FIG. 2B, the rotational position and the angle of the core need to be determined in order to retrieve the horizontal plug 204*b* and vertical plug 202*b*. To accurately orient the core, the presence of geologic indicators is determined. That is, geologic features can be used to help determine the proper orientation of the core sample. For example, bedding features, such as standard sedimentary bedding features can be used to determine the proper orientation of the core sample as such features are typically horizontal. Based on such features, a slope angle (borehole deviation angle) of the core sample can be determined. Such an assessment can be done by a lab technician or a geologist.

Once the proper orientation has been determine based upon the geologic indicators, the core sample, or the plug retrieval devices, are oriented to retrieve the plug samples, in the proper orientation (vertical or horizontal). The vertical plug 202*b*, the horizontal plug 204*b*, or both are then retrieved from the core sample 200*b*. Alternatively or in addition, a "top" of the core sample is marked after the proper orientation is determined. For example, the top of the core can be marked with a marker. Such markings can be used to quickly identify proper orientation of core samples that are stored and retrieved, for example, from a shipping crate or an archive.

Figure 2C:
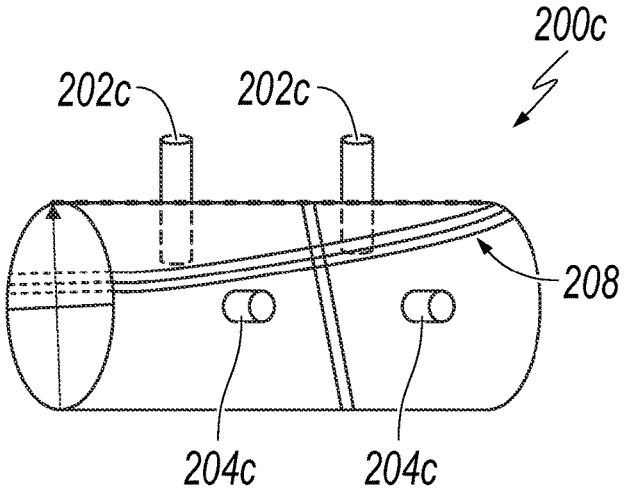
FIG. 2C is a side cross sectional view of an example horizontal core sample marked to have vertical and horizontal plugs removed.

FIG. 2C is a side cross-sectional view of an example horizontal core sample 200*c* marked to have vertical plugs 202*c* and horizontal plugs 204*c* removed. For horizontal cores, the presence of cross bedding 208 allows for a correct orientation to be determined. Cross-bedding 208 in the context of this disclosure refers to geologic features that cross the horizontal plane, for example, graded bedding or trough cross bedding. Such features can be used as indicators because of the "finning up" pattern that is visible on the core sample when such features are present. These features can be used to properly orient the horizontal core sample 200*c* such that the vertical plug 202*c*, the horizontal plug 204*c*, or both can be retrieved from the core sample 200*c*. Similarly to the deviated core sample 200*b*, the horizontal core sample 200*c* can be oriented, for example, rotated, after the proper orientation is determined.

Figure 3A:
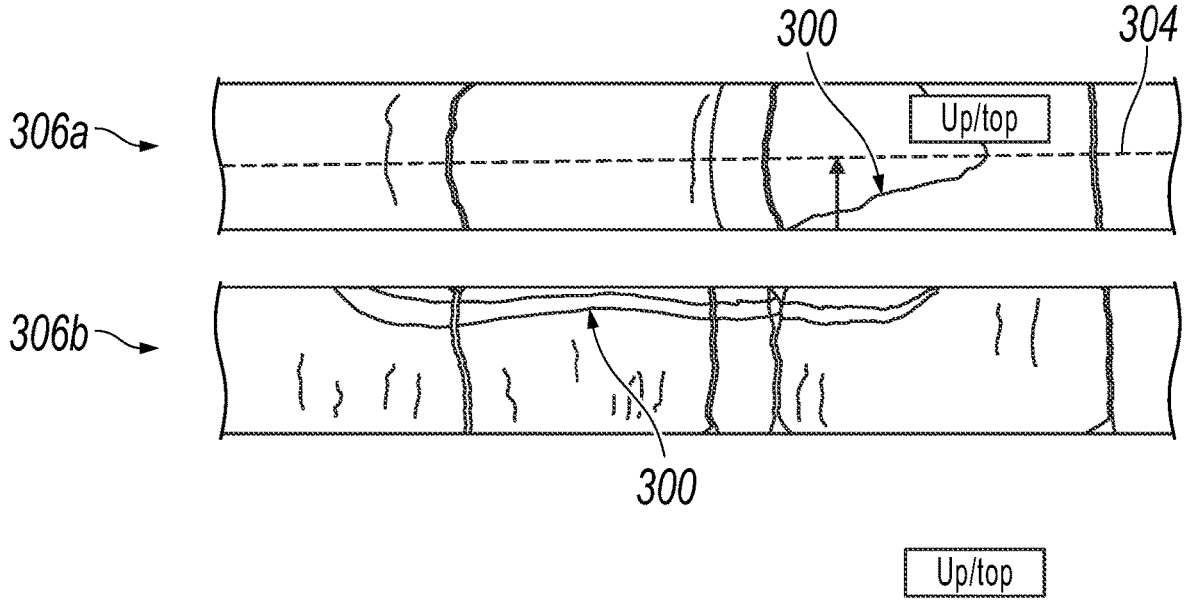
FIGS. 3A-3B are whole core and slabbed core views of example geologic indicators within core samples that can be used with aspects of this disclosure.
Figure 3B:
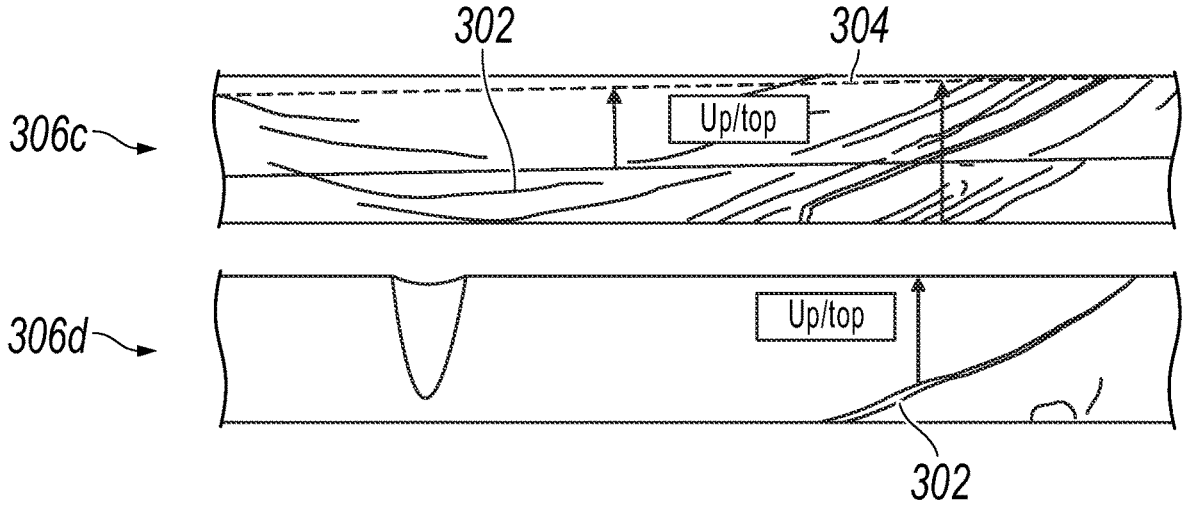

FIGS. 3A-3B are whole core (306*a*, 306*c*) and slabbed cores (306*b*, 306*d*) views of example geologic indicators within core samples that can be used with aspects of this disclosure. More specifically, the specific sedimentary structures always pointing up direction, such as, graded bedding 300 (finning up sequence) and trough cross bedding 302 (trough always pointing up). Up/top direction features 300 created by graded bedding and created by trough cross bedding 302 within horizontal core samples is illustrated. To orient (rotate) the core, the finning up sequences 300 of the geologic indicators are oriented such that an up/top line 304 of the core is directly upwards. Similarly, trough cross bedding sequences 302 of the geologic indicators are oriented such that the up/top line 304 of the core is directed upward. Once the core is oriented, a top of the core can be marked with a writing instrument, such as a marker or grease pencil. In some implementations, a protractor or a straight edge can also be used.

Figure 4C:
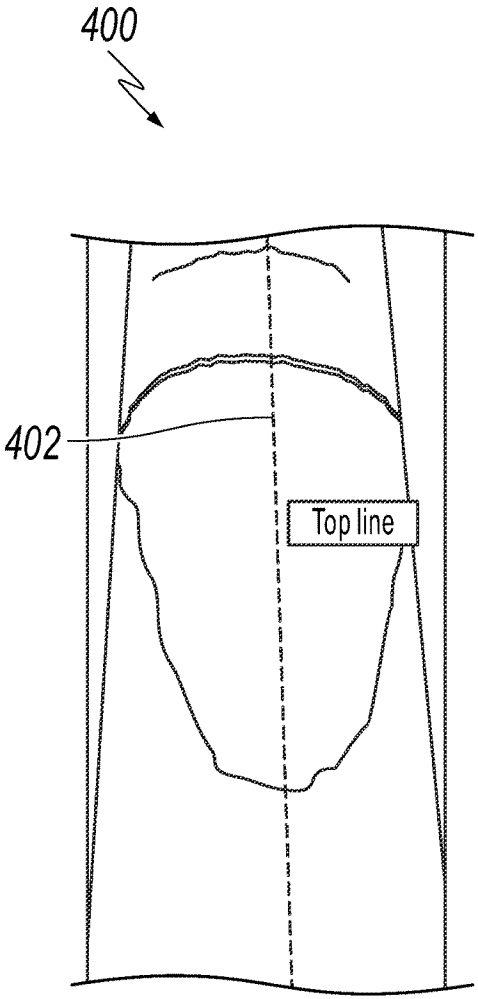
FIGS. 4A-4C illustrate various core sample segments with a marked topline.
Figure 4B:
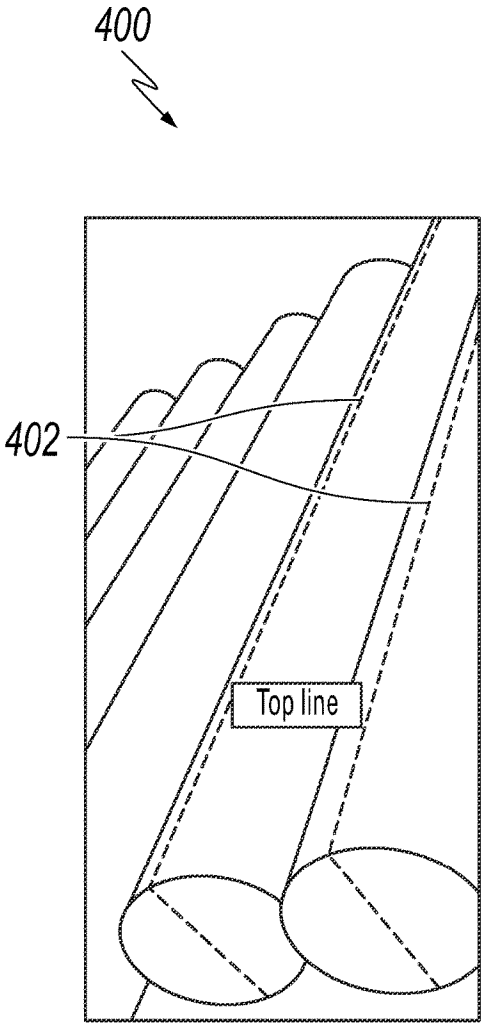
Figure 4A:
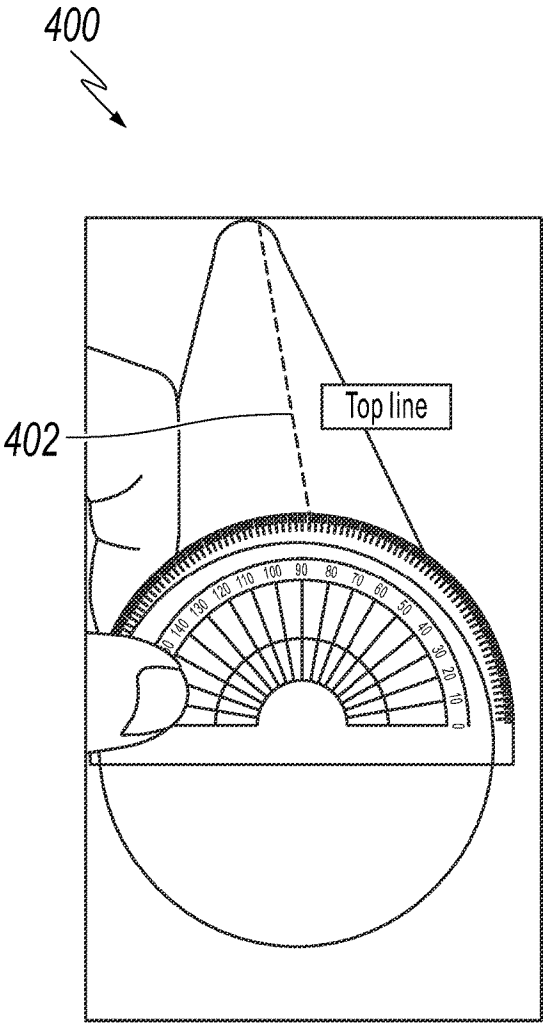

FIGS. 4A-4C illustrate various core sample segments 400 with marked top lines 402. The ability to properly orient a core sample can be applied to multiple core segments of a single core sample. Core samples can be purposely or accidentally broken into multiple segments. Purposeful breaks can occur to package the cores for shipping or processing. Accidental breakages can occur during shipping or handling. Regardless of the cause of the breakage, orienting the core segments with one another can be useful for testing purposes. Orienting core segments to one another is done by orienting each individual segment as previously described. Once the first core segment is oriented, a second core segment is received and is subjected to the same method of orientation. Once both the first segment and the second segment have been oriented, their top lines 402 are marked. Once the top lines 402 are marked, the marks on the first segment and the second segment are aligned.

Figure 5:
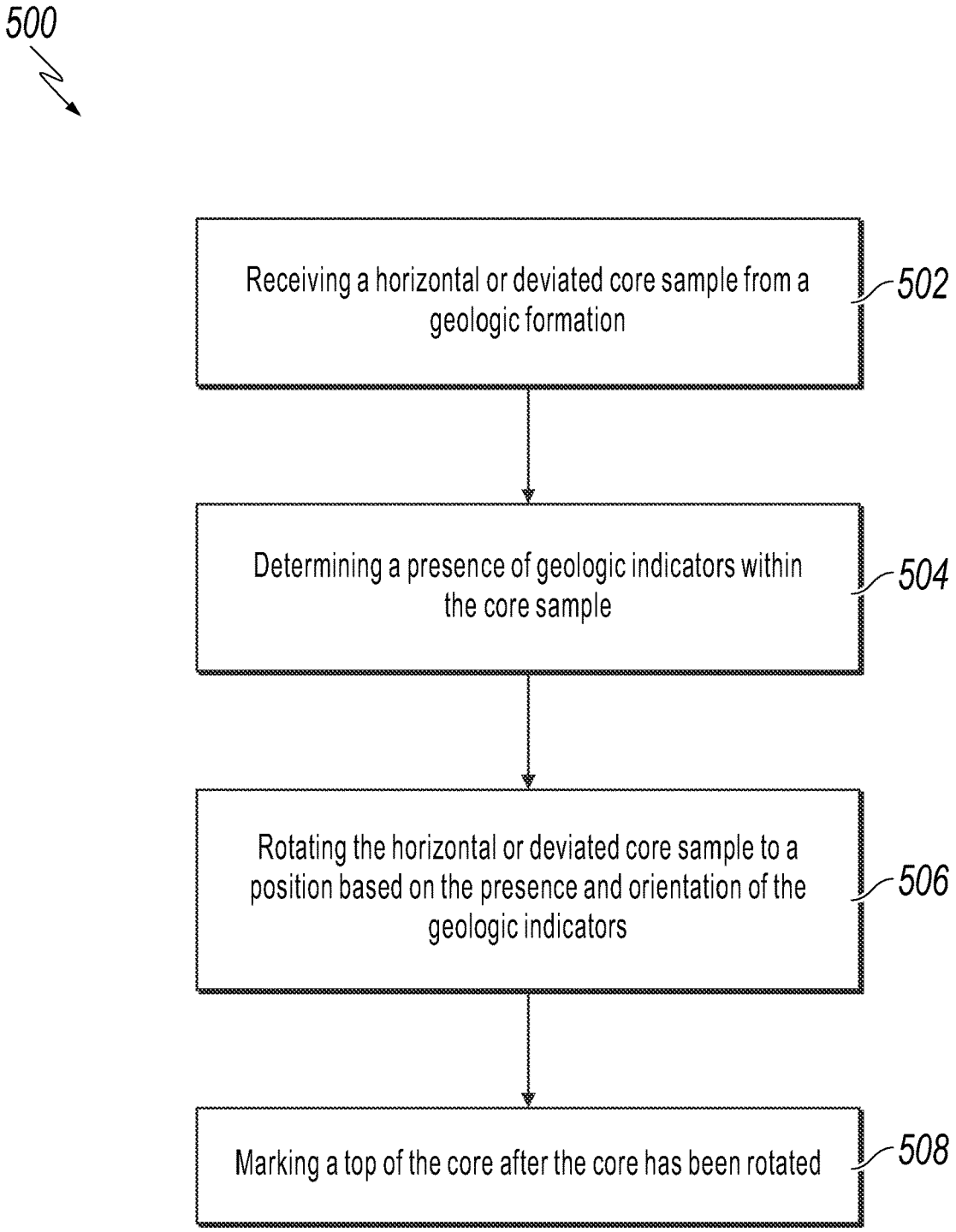
FIG. 5 is a flowchart of an example method that can be used with aspects of this disclosure.

FIG. 5 is a flowchart of an example method 500 that can be used with aspects of this disclosure. At 502, a horizontal or deviated core sample is drilled or received from a geologic formation, such as geologic formation 104. At 504, presence of geologic indicators is determined to be within the core sample, wherein the geologic indicators comprise graded bedding or cross bedding. At 506, the core horizontal or deviated sample is rotated to a position based on the presence and orientation of the geologic indicators. For example, the core sample can be rotated such that finning up sequences of the geologic indicators are oriented such that the up/top of the core is directly upwards or that trough sequences of the geologic indicators are oriented such that a up/top line of the trough is directed upward. At 508, a top of the core is marked after the core has been rotated.

Figure 6A:
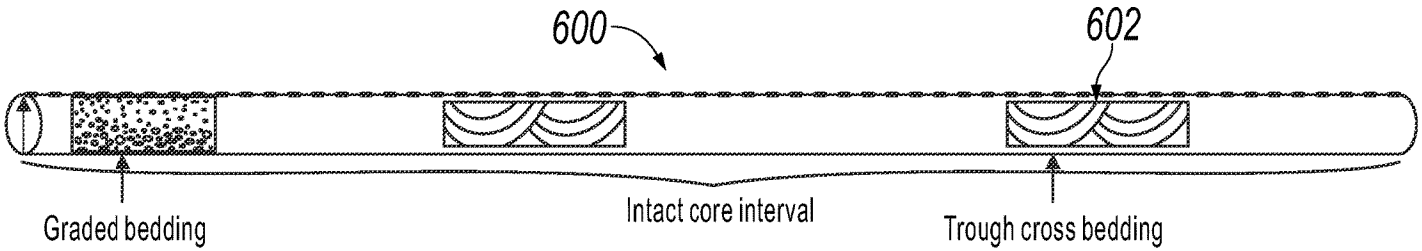
FIGS. 6A-6D show side views of core samples in various states.
Figure 6B:
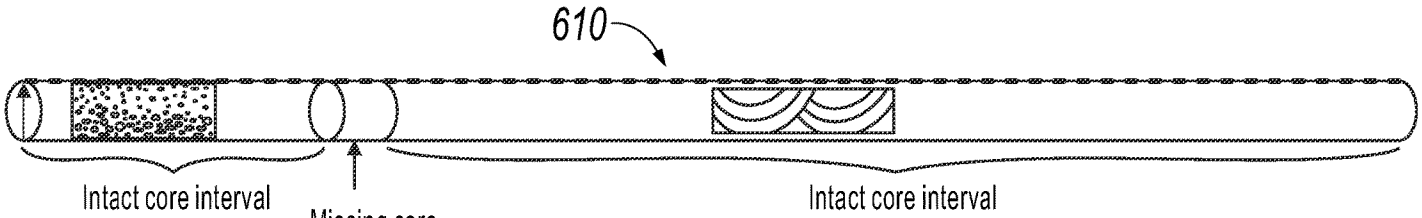

Similar methods can be used to retrieve a second core sample from a same wellbore as the first core sample. FIGS. 6A-6D show side views of core samples in various states. FIG. 6A illustrates a core sample 600 that is substantially intact with trough cross bedding 602 and graded bedding 604. FIG. 6B illustrates a core sample 610 that is in separate pieces with a missing interval between pieces. As each interval includes a section with trough cross bedding 602 of graded bedding 604, then the intervals can be aligned with one another.

Figure 6C:
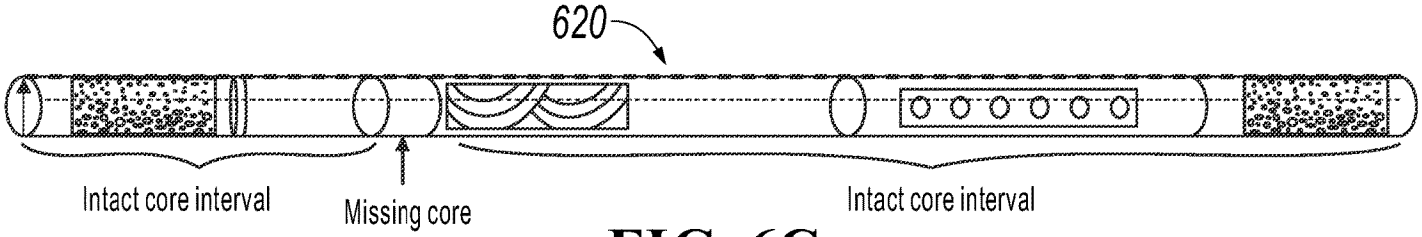
Figure 6D:
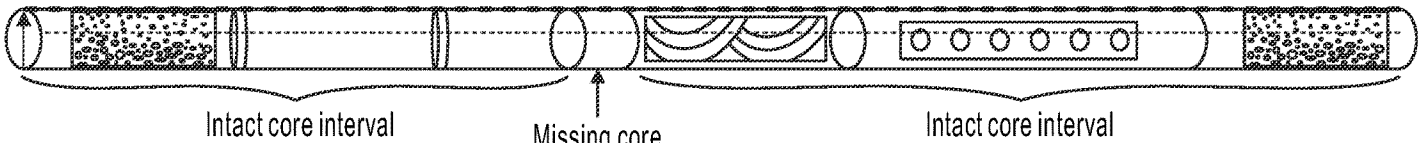

FIG. 6C illustrates a core sample 620 includes multiple core intervals with a missing interval. The remaining intervals include geologic features (for example, trough cross bedding 602 of graded bedding 604), intervals with plugs already retrieved, or both. FIG. 6D is similar. Such features can be used to align the separate intervals. For example, after the first horizontal or deviated core sample is processed, a second core sample can be drilled and retrieved from a same wellbore as the first core sample. In some implementations, a vertical plug can be retrieved from the first core sample, the second core sample, or both core samples. Alternatively or in addition, a horizontal plug can be retrieved from the first core sample, the second core sample, or both core samples.

While this specification contains many specific implementation details, these should not be construed as limitations on the scope of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method of orienting a horizontal or deviated core sample, the method comprising:

receiving the horizontal or deviated core sample from a wellbore, wherein the horizontal or deviated core sample includes a cylindrical outer surface;

determining a presence of geologic indicators within the horizontal or deviated core sample;

determining a top of the cylindrical surface extracted from a depth less than a bottom of the cylindrical surface based on the presence and orientation of the geological indicators;

rotating the horizontal or deviated core sample to a position based on the determined top and bottom; and marking the top of the horizontal or deviated core sample after the core sample has been rotated.

2. The method of claim 1, wherein the core sample is a horizontal core sample, wherein the geologic indicators comprise:

graded bedding; or trough cross bedding.

3. The method of claim 1 wherein rotating the core sample comprises rotating the core sample such that finning up sequences of the geologic indicators are oriented such that a top line of the core sample is directed upwards.

4. The method of claim 1, wherein rotating the core sample comprises rotating the core sample such that trough sequences of the geologic indicators are oriented such that a top line of the trough is directed upwards.

5. The method of claim 1, wherein marking comprises marking the top of the core sample with a writing instrument.

6. The method of claim 1 further comprising:

retrieving a vertical plug from the core sample; and retrieving a horizontal plug from the core sample.

7. The method of claim 6, wherein the core sample is a deviated core sample, wherein retrieving the vertical plug comprises:

determining a slope angle of the core sample; and orienting the core sample such that the vertical plug can be taken based on the determined slope angle.

8. The method of claim 1, wherein the core sample is a first core sample, the method further comprising:

receiving a second core sample from the wellbore, the second core sample being from a same borehole as the first core sample;

determining a presence of geologic indicators in the second core sample;

rotating the second core sample in response to the presence and location of the geologic indicators in the second core sample;

marking a top of the second core sample after the second core sample has been rotated; and aligning the mark of the first core sample and the mark of the second core sample.

9. A method comprising:

drilling a horizontal or deviated core sample from a geologic formation, wherein the horizontal or deviated core sample includes a cylindrical outer surface;

determining a presence of geologic indicators within the core sample;

determining a top of the cylindrical surface extracted from a depth less than a bottom of the cylindrical surface based on the presence and orientation of the geological indicators;

rotating the core sample to a position based on the determined top and bottom; and marking the top of the core sample after the core sample has been rotated.

10. The method of claim 9, wherein the geologic indicators comprise:

graded bedding; or trough cross bedding.

11. The method of claim 9 wherein rotating the core sample comprises rotating the core sample such that finning up sequences of the geologic indicators are oriented such that a top line of the core sample is directed upwards.

12. The method of claim 9, wherein rotating the core sample comprises rotating the core sample such that trough sequences of the geologic indicators are oriented such that a top line of the trough is directed upwards.

13. The method of claim 9, wherein marking comprises marking the top of the core sample with a writing instrument.

14. The method of claim 9 further comprising:

retrieving a vertical plug from the core sample; and retrieving a horizontal plug from the core sample.

15. The method of claim 14, wherein retrieving the vertical plug comprises:

determining a slope angle of the core sample; and orienting the core sample such that the vertical plug can be taken based on the determined slope angle.

16. The method of claim 9, wherein the core sample is a first core sample, the method further comprising:

receiving a second core sample from the geologic formation, the second core sample being from a same borehole as the first core sample;

determining a presence of geologic indicators in the second core sample;

rotating the second core sample in response to the presence and location of the geologic indicators in the second core sample;

marking a top of the second core sample after the second core sample has been rotated; and aligning the mark of the first core sample and the mark of the second core sample.

17. The method of claim 16, wherein receiving the second core sample comprises drilling the second core sample from the same wellbore as the first core sample.

18. A method comprising:

drilling a horizontal or deviated core sample from a geologic formation, wherein the horizontal or deviated core sample includes a cylindrical outer surface;

determining a presence of geologic indicators within the core sample, wherein the geologic indicators comprise graded bedding or trough cross bedding;

determining a top of the cylindrical surface extracted from a depth less than a bottom of the cylindrical surface based on the presence and orientation of the geological indicators;

rotating the core sample to a position such that finning up sequences of the geologic indicators are oriented such that a top line of the core sample is directed upwards or that trough sequences of the geologic indicators are oriented such that a top line of the trough is directed upwards, wherein the position is based on the determined top and bottom; and marking the top of the core sample after the core sample has been rotated.

19. The method of claim 18, wherein the core sample is a first core sample, the method further comprising:

drilling a second core sample from the geologic formation, the second core sample being from a same borehole as the first core sample;

determining a presence of geologic indicators in the second core sample, wherein the geologic indicators comprise graded bedding or trough cross bedding;

rotating the second core sample to a position such that finning up sequences of the geologic indicators are oriented such that a top line of the second core is directed upwards or that trough sequences of the geologic indicators are oriented such that a top line of the trough is directed upwards;

marking a top of the second core sample after the second core sample has been rotated; and aligning the mark of the first core sample and the mark of the second core sample.

20. The method of claim 19 further comprising:

retrieving a vertical plug from the second core sample; and retrieving a horizontal plug from the second core sample.

* * * * *